US005586087A

United States Patent [19]

Silverson

[11] Patent Number: 5,586,087

[45] Date of Patent: Dec. 17, 1996

[54] CONTAINER

[76] Inventor: Roy S. Silverson, 4086 West 27th Avenue, Vancouver, BC, Canada

[21] Appl. No.: 547,102

[22] Filed: Oct. 23, 1995

[51] Int. Cl.[6] ..... G04B 47/00

[52] U.S. Cl. ..... 368/10; 206/534; 215/230

[58] Field of Search ..... 368/10, 276, 278; 206/534; 215/230, 219, 220

[56] References Cited

U.S. PATENT DOCUMENTS

| | | | |
|---|---|---|---|
| 1,425,456 | 8/1922 | Dial . | |
| 3,071,271 | 1/1963 | Thomas . | |
| 3,393,816 | 7/1968 | Grimm . | |
| 3,432,065 | 3/1969 | Bugla . | |
| 3,628,679 | 12/1971 | Armour . | |
| 3,766,882 | 10/1973 | Babbitt, III . | |
| 3,812,989 | 5/1974 | Horvath . | |
| 3,860,137 | 1/1975 | Wilson . | |
| 3,896,959 | 7/1975 | Roy . | |
| 3,960,713 | 6/1976 | Carey . | |
| 3,996,879 | 12/1976 | Walton | 116/121 |
| 4,043,474 | 8/1977 | McCord . | |
| 4,238,033 | 12/1980 | Artzt . | |
| 4,432,300 | 2/1984 | Lyss | 206/534 |
| 4,501,370 | 2/1985 | Kelley . | |
| 4,511,049 | 4/1985 | Aboud . | |
| 4,528,933 | 7/1985 | Allen . | |
| 4,749,093 | 6/1988 | Trick . | |
| 4,802,438 | 2/1989 | DeJonge . | |
| 5,011,032 | 4/1991 | Rollman | 215/230 |
| 5,279,422 | 1/1994 | Adams | 206/534 |
| 5,358,117 | 10/1994 | Adams | 206/534 |

*Primary Examiner*—Vit W. Miska

*Attorney, Agent, or Firm*—Kolisch, Hartwell, Dickinson, McCormack & Heuser

[57] ABSTRACT

A container for a composition to be taken. The container has a body to hold the composition and a closure to rotate on the body. The container contains a marker on the closure and corresponding indicia on the body to indicate the position of the closure on the body. The closure and the body are formed in such a way that the position of one relative to the other can be fixed. There is a circumferential lip adjacent the top of the body and an opening in the lip. A projection on the closure engages the lip to prevent indiscriminate removal of the closure from the body. The projection is alignable with the opening in the lip to permit removal of the closure from the body.

8 Claims, 3 Drawing Sheets

CONTAINER

FIELD OF THE INVENTION

This invention relates to a container. It finds particular application in a container used to hold medication, vitamin pills and the like that should be taken according to a timetable.

DESCRIPTION OF THE PRIOR ART

There have been a number of suggestions to mark containers so that pills can be taken at an appropriate time. This can be extremely important. It is possible for people of any age to forget when they should take, or whether they have taken, a pill and the problem is exacerbated with age or with patients taking multi and varying regimens. The effects of missing a pill or taking a double dose can be serious in the case of medication. In addition, doctors are concerned that prescription medication be taken in a relatively closely defined regimen for maximum effectiveness and to avoid the possibility of over-dosing.

Examples of a large numbers of attempts to solve this problem include U.S. Pat. Nos. 1,425,456 to Dial; 3,766,882 to Babbitt; 3,960,713 to Carey; 4,238,033 to Artzt; 4,501,370 to Kelley; 4,528,933 to Allen and 4,802,438 to DeJonge.

Despite the substantial number of patents in the field, these devices have not achieved commercial success. Birth control pills are sold in containers that are marked to assist in the taking of the pills at prescribed intervals. However, these containers are relatively large, flat bodies. Their marking is relatively simple as, of course, only one pill is taken per day. This is an unusual regimen for medicines which, typically, would be taken three or four times a day.

Pill receptacles that are child resistant are now extremely well known. Indeed, most jurisdictions require these child resistant closures on medicine containers. These child resistant closures take a variety of forms. A popular embodiment is the use of a lip formed on the part of the container that holds the medicine with a single, relatively small opening in it. The closure is formed with a projection that abuts the underside of the lip so that the closure cannot be removed unless the projection is aligned with the opening in the lip. The idea is that a child young enough to take these medicines accidentally, who could be harmed by the medicine, will not have the reasoning ability to align the projection and the lip opening to remove the closure.

Other embodiments require that pressure be applied radially to opposed sides of the closure, or that the closure be pressed downwardly to allow the release of fasteners prior to removal of the closure. These devices have met with good acceptance and are commonly available. But they do not lend themselves to versatile indicia means.

Patents known to applicant that describe and claim child resistant closures are U.S. Pat. Nos. 3,071,271 to Thomas; 3,393,816 to Grimm; 3,432,065 to Bugla; 3,628,679 to Armour; 3,812,989 to Horvath; 3,860,137 to Wilson; 3,896,959 to Roy; 4,043,474 to McCord; 4,511,049 to Aboud and 4,749,093 to Trick.

Applicant is not aware of a satisfactory container that will tell the user whether a pill has been taken. In the main, the problem is that although the user may set the prior mechanism adequately, the closure cannot be relied upon to remain in the set position, in the absence of complex, cumbersome and costly mechanisms, but without which the containers can do more harm than good in that they compound the confusion. Moreover, no prior art describes a means to provide the patient with information as to when medicines have been taken and when to take medicine.

There is therefore still a necessity for a simple and inexpensive container that is both child resistant and contains a clear indication of a regimen for taking, and recording the taking of, the pills and in which that indication cannot be disturbed inadvertently. Most importantly, such a device must be so simple as to result in the low cost needed to permit replacement of the presently acceptable containers that lack the above capability.

The present invention addresses these problems.

SUMMARY OF THE INVENTION

Accordingly, the present invention provides a container comprising a body to hold a composition and a closure able to rotate on the body, including a marker on the closure and corresponding indicia on the body to indicate the position of the closure on the body; first means on the closure and second means on the body to cooperate to fix the position of the closure on the body; a circumferential lip adjacent the top of the body; an opening in the lip; and a projection on the closure to engage the lip to prevent indiscriminate removal of the closure from the body, but said projection being alignable with said opening in the lip to permit removal of the closure from the body.

DESCRIPTION OF THE DRAWINGS

The invention is illustrated in the drawings in which.

DESCRIPTION OF THE PREFERRED EMBODIMENTS

Figure 5A:
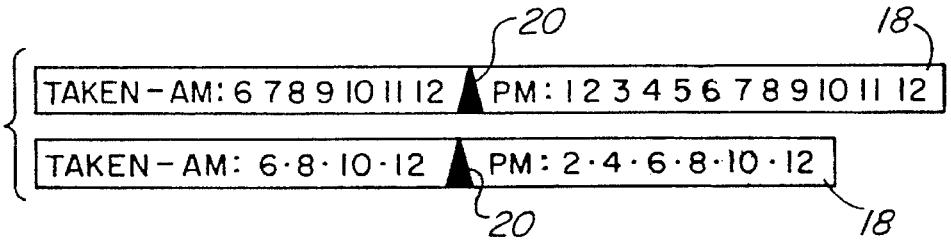
FIGS. 5A through 5D illustrate various indicia useful with the containers of FIGS. 1 through 4.

The drawings show a container 10 for a composition. The container 10 comprises a body 12 to hold the composition and a closure 14 for the body 12. The closure is able to rotate on the body 12. There is a marker on the closure 14. The marker takes the form of a simple arrow head 16 in the drawings. There are indicia on the container to indicate the position of the closure 14 on the body 12. FIGS. 5A through 5D illustrate these indicia. In FIG. 5A the indicia comprises simple time indications on a band 18 indicating when the composition was taken. There is also an arrow head 20 which is used to indicate the position of the closure 14 on the body 12. This arrow head 20, when aligned with arrow head 16, indicates when the closure 14 may be removed from the body 12.

Figure 5B:
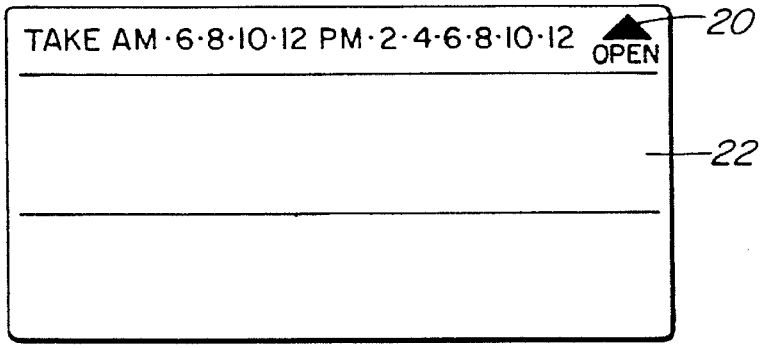
Figure 5C:
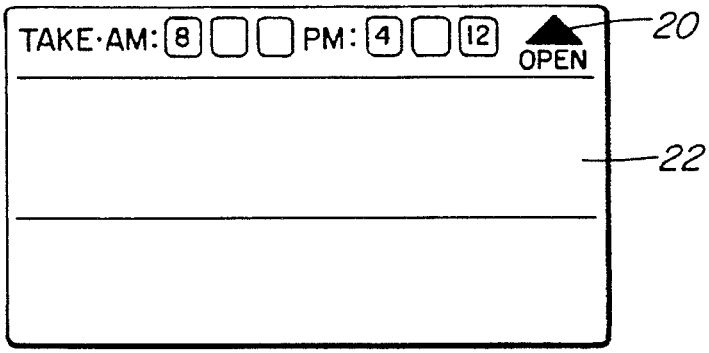
Figure 5D:
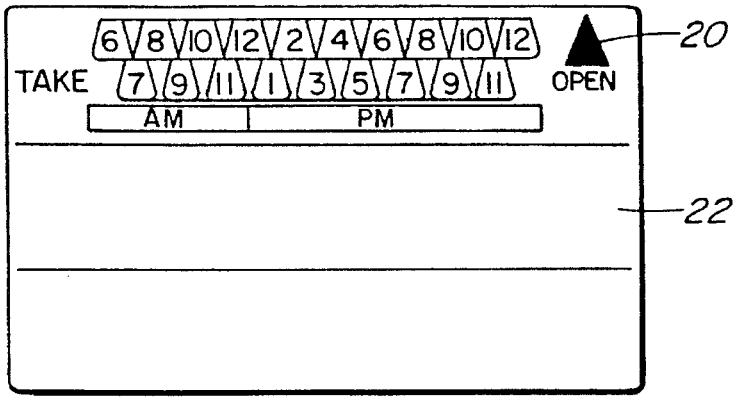

FIGS. 5B, 5C and 5D are relatively more sophisticated variations of FIG. 5A. These embodiments provide various means for the patient to pre-record a chosen regimen and thus establish a means to determine both when medicine must be taken and when medicine has been taken. Again, there is a marker 20 to indicate when the closure 14 can be removed from the body 12.

The embodiments of FIGS. 5B, 5C and 5D are used as addendums to a labelling typically provided by dispensing pharmacies and may be considered preferable to the embodiment of FIG. 5A in that space is provided to accommodate prescription information such as the name of the patient, the dispensing pharmacy and the prescription regimen, all in conventional manner. The labels may be modified by variation of the indicia design depending, for example, on popular acceptance each having distinctive merit insofar as popular acceptance might indicate. In general, the size of the container will determine which of the indicia of FIG. 5A, imprinted during the container's manufacturing process, is to be used, while the indicia media of FIGS. 5B, 5C and 5D are of universal dimensions.

Using the embodiments of FIGS. 5A, 5B, 5C and 5D, the patient adds marking to the band or labels depending on the prescribed regimen. For example, in the embodiments of FIGS. 5A and 5B, the patient may mark vertical lines through the hours or symbols denoting intermediate hours, at which the medication is to be taken. In FIG. 5D circling or highlighting of a number, for example with ball-point pen or with marker pen, can be used. In the embodiment of FIG. 5C, the appropriate times may be inserted in the small rectangles. An example of a typical regimen is shown in FIG. 5C but it is, of course, merely an example.

Figure 1:
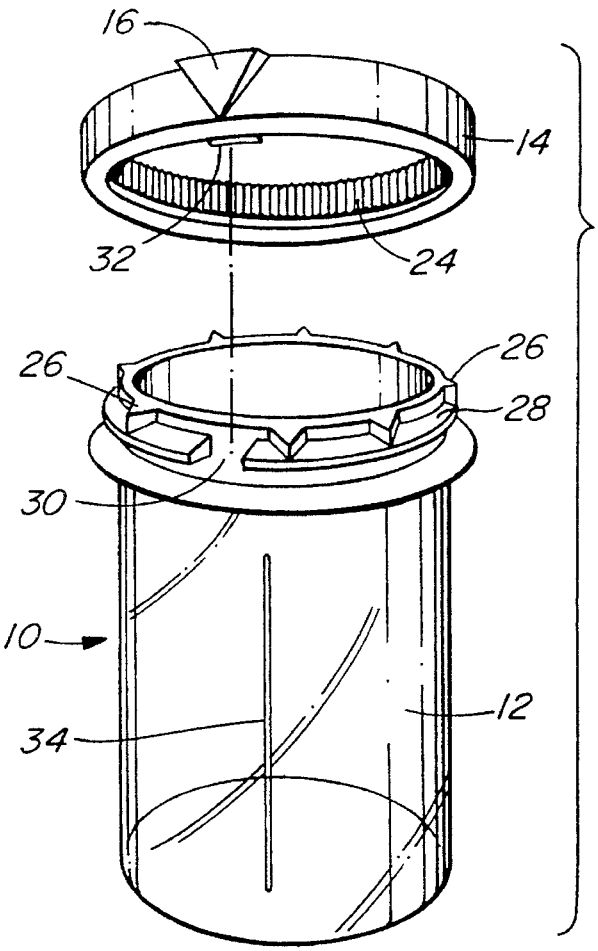
FIG. 1 is an exploded view of a container according to the present invention.
Figure 2:
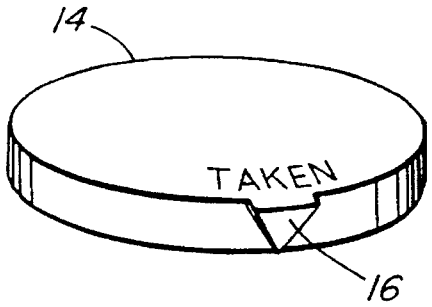
FIG. 2 is an external view of the closure of FIG. 1.
Figure 3:
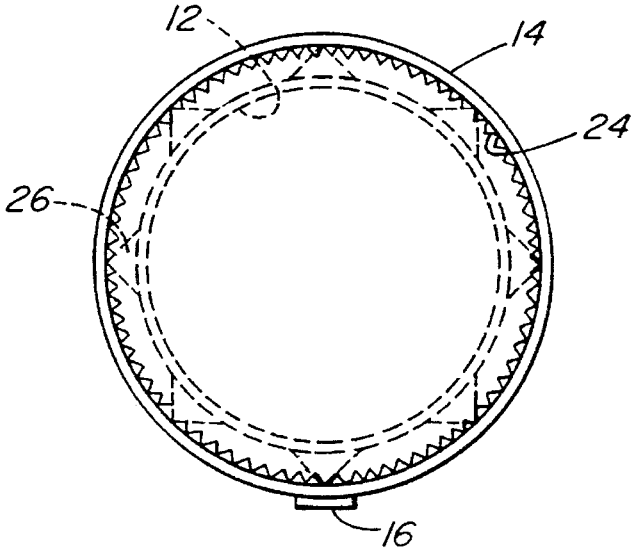
FIG. 3 is an internal view of the closure of FIGS. 1 and 2.

There are means on the closure 14 and on the body 12 to co-operate to fix the position of the closure 14 on the body 12. In FIG. 1, there are a relatively large number of teeth 24 formed on the interior of the closure 14. The body 12 is formed with relatively few longer teeth 26. The teeth 24 and 26 are mutually engagable. Although the closure 14 can be rotated by the application of force by hand, it will not rotate inadvertently when carried.

There is a circumferential lip 28 adjacent the top of the body 12 with an opening 30 in the lip 28. There is a projection 32 on the closure 14 to engage the lip 28 to prevent indiscriminate removal of the closure 14 from the body 12. The projection 32 is alignable with the opening 30 in the lip 28 to permit removal of the closure 14 from the body 12; that is the container 10 is child-resistant.

There is a mark 34 on the exterior of the body 12 which indicates to the pharmacist where the label 22 should be positioned. In the embodiments of FIGS. 5B, 5C and 5D, the end of the label to the right of the drawings is aligned with the mark 34 which ensures that the marker 20 on the label 22 aligns with the opening 30 in the lip 28.

Figure 4:
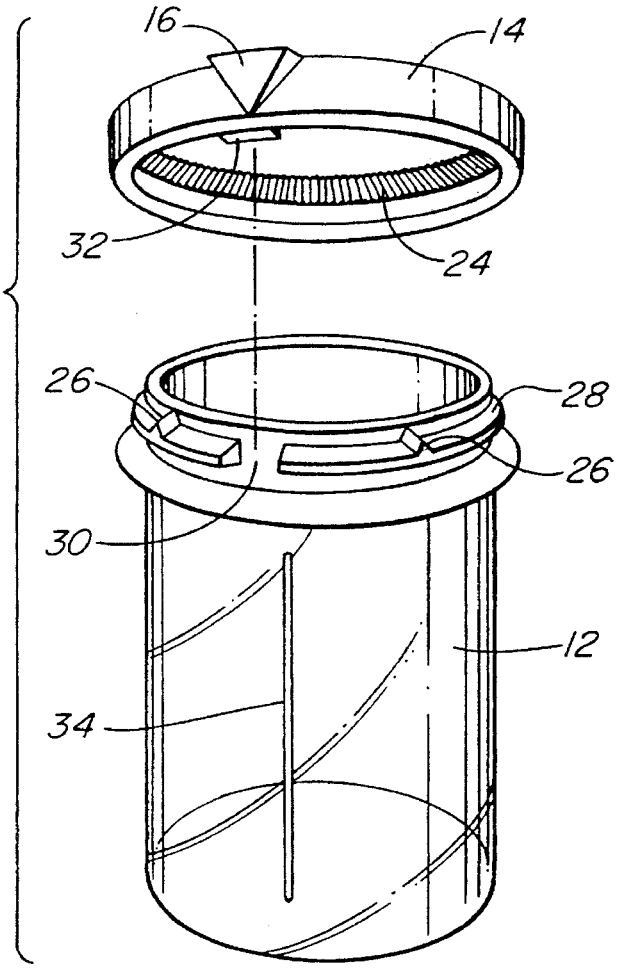
FIG. 4 is an exploded view of a further container according to the present invention.

FIG. 4 illustrates a variation of the embodiment of FIG. 1. The teeth 26 are downwardly inclined on lip 28. The teeth 24 in the closure are similarly inclined.

The apparatus of the present invention can be used with great ease. The child-resistant feature of the invention is conventional. In other words, to remove the closure 14, the arrow 16 on the closure 14 is aligned with the arrow 20 on the labels 22 or band 18 which tells the user that the projection 32 on the interior of the closure 14 is aligned with the opening 30 in the lip 28. The closure may then be removed.

The particular virtue of the present invention is that the teeth 24 and 26 engage and prevent inadvertent rotation of the closure 14. With the closure removed, as shown in FIGS. 1 and 4, a pill may be removed from the body 12 at the appropriate, and previously indicated time, and taken. The closure 14 is then replaced on the body 12 simultaneously aligning arrow 16 with the appropriate indicia on labels 18 and 22 to denote time taken and, in the case of label 22, to denote also the next time at which medicine is to be taken.

The next time a pill is required to be taken, the closure 14 is rotated by hand, overcoming the engagement of the teeth 24 and 26, to the open position, the closure removed and the pill taken. The closure is then replaced and set to a position where it clearly indicates the time when the pill was taken. In this way, a clear record of the times at which the pills were taken is provided.

Figure 6:
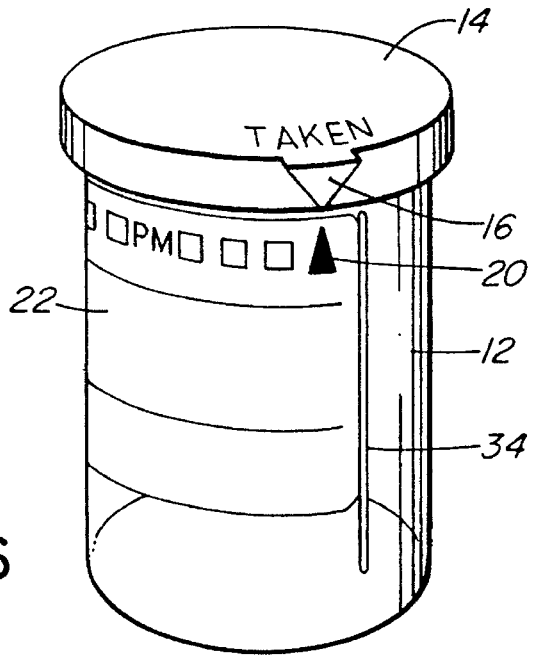
FIG. 6 shows the closure of FIG. 2 in place on the container and with a label applied.

FIG. 6 shows a container and typical indicia with the closure rotated to a position where it may be removed. On replacement, the arrow 16 will be aligned with the time at which the medicine has just been taken. The word "TAKEN" on closure 14 acts as a reminder in this regard. FIGS. 6 also shows the use of mark 34 to locate the label 22 correctly.

The body may be made of the usual plastics from which such containers are made in the prior art. Transparency is, in general, desirable. Similarly the closure can be made from the same resilient plastics used in the prior art to make closures.

Although the forgoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

I claim:

1. A container for a composition to be taken, the container comprising a body to hold the composition and a closure able to rotate on the body, the container including:

a marker on the closure and corresponding indicia on the body to indicate the position of the closure on the body;

first means on the closure and second means on the body to cooperate to fix the position of the closure on the body;

a circumferential lip adjacent the top of the body;

an opening in the lip; and a projection on the closure to engage the lip to prevent indiscriminate removal of the closure from the body, but said projection being alignable with said opening in the lip to permit removal of the closure from the body.

2. A container as claimed in claim 1 in which the marker on the closure is a projection on the outer periphery of the closure.

3. A container as claimed in claim 1 in which the indicia on the body comprise markings of time and a marker to indicate the location of the opening in the lip.

4. A container as claimed in claim 3 in which the indicia are combined on a single label.

5. A container as claimed in claim 4 in which the body includes a mark on its exterior to indicate how the label should be positioned.

6. A container as claimed in claim 1 in which the first means in the closure and the second means in the body comprise mutually engagable teeth that hold when the container is at rest but can be released by hand pressure.

7. A container as claimed in claim 6 in which there are relatively few teeth on said body and a relatively large number of teeth on said closure.

8. A container as claimed in claim 1 comprising only two parts, the body and the closure, the remaining integers being integral with either the body or the closure.

* * * * *